US012171317B2

(12) United States Patent
Meersschaert et al.

(10) Patent No.: US 12,171,317 B2
(45) Date of Patent: Dec. 24, 2024

(54) LUGGAGE CASE WITH REMOVABLE STORAGE

(71) Applicant: Samsonite IP Holdings S. a.r.l., Luxembourg (LU)

(72) Inventors: Reinhard Meersschaert, Merelbeke (BE); Serge Raoul F. Vanheck, Elversele (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 17/527,297

(22) Filed: Nov. 16, 2021

(65) Prior Publication Data

US 2022/0151360 A1 May 19, 2022

(30) Foreign Application Priority Data

Nov. 17, 2020 (EP) ..... 20207997

(51) Int. Cl.

| | |
|---|---|
| ***A45C 13/28*** | (2006.01) |
| ***A45C 5/02*** | (2006.01) |
| ***A45C 5/06*** | (2006.01) |
| ***A45C 5/14*** | (2006.01) |
| ***A45C 13/26*** | (2006.01) |

(52) U.S. Cl.

CPC ..... *A45C 13/28* (2013.01); *A45C 5/02* (2013.01); *A45C 5/06* (2013.01); *A45C 5/14* (2013.01); *A45C 13/262* (2013.01); *A45C 2013/267* (2013.01)

(58) Field of Classification Search

CPC ..... A45C 13/28; A45C 5/02; A45C 5/06; A45C 5/14; A45C 13/262; A45C 2013/267; A45C 13/26

See application file for complete search history.

(56) References Cited

U.S. PATENT DOCUMENTS 3,559,778 A * 2/1971 D'Elia ..... A45C 13/04 190/100
4,122,925 A 10/1978 Schultheiss
(Continued)

FOREIGN PATENT DOCUMENTS

AU 2018101671 A4 * 12/2018 ..... A45C 13/28
CN 207969811 U * 10/2018
(Continued)

OTHER PUBLICATIONS

Yinke: https://www.amazon.com/Fromsky-SanDisk-Portable-External-Protective/dp/B081SVSNVB (Year: 2019).*
(Continued)

*Primary Examiner* — Don M Anderson
*Assistant Examiner* — Justin Caudill
(74) *Attorney, Agent, or Firm* — Dorsey & Whitney LLP

(57) ABSTRACT

The present disclosure relates to a luggage article including a rear panel; a grip handle including a pair of spaced-apart tubes mounted on the rear panel; a recess defined between the tubes; and a removable pocket removably mountable in the recess between the tubes, wherein the removable pocket and the recess include corresponding inter-engaging engagement features to at least partially retain the pocket within the recess.

19 Claims, 13 Drawing Sheets

(56) References Cited

U.S. PATENT DOCUMENTS

| | | | | |
|---|---|---|---|---|
| 5,575,362 | A * | 11/1996 | Franklin | A45C 13/262 190/102 |
| 10,531,716 | B2 * | 1/2020 | Sluder | A45C 15/00 |
| 10,582,789 | B2 * | 3/2020 | Klugh | A47G 23/0225 |
| 2003/0164273 | A1 * | 9/2003 | Nykoluk | A45C 13/28 190/101 |
| 2008/0121554 | A1 * | 5/2008 | Townsend | A45C 5/06 206/570 |
| 2011/0132708 | A1 * | 6/2011 | DeLine | A45C 13/00 190/115 |
| 2012/0152677 | A1 * | 6/2012 | Lu | A45C 5/14 190/18 A |
| 2012/0292313 | A1 * | 11/2012 | Erlich | A45C 7/0077 220/9.2 |
| 2015/0101958 | A1 * | 4/2015 | Cross | A45C 11/38 206/703 |
| 2018/0000215 | A1 * | 1/2018 | Korey | A45C 13/1023 |
| 2019/0045899 | A1 * | 2/2019 | Bhatnagar | A45C 13/28 |
| 2019/0069659 | A1 * | 3/2019 | Van Loon | A45C 13/02 |
| 2019/0212782 | A1 * | 7/2019 | Okada | H01M 50/209 |
| 2019/0214839 | A1 * | 7/2019 | Goldner | H02J 7/04 |
| 2019/0280261 | A1 | 9/2019 | Cheon | |

FOREIGN PATENT DOCUMENTS

| | | | | |
|---|---|---|---|---|
| CN | 108851425 | A | 11/2018 | |
| CN | 110025105 | A * | 7/2019 | |
| CN | 110141032 | A * | 8/2019 | A45C 13/262 |
| CN | 110691535 | A * | 1/2020 | A45C 13/00 |
| DE | 202018103811 | U1 * | 10/2018 | A45C 13/001 |
| EM | 008274054-0002 | | 11/2020 | |
| EP | 2829192 | A1 * | 1/2015 | A45C 13/262 |
| EP | 3021705 | B1 | 7/2017 | |
| WO | 2015008228 | A1 | 1/2015 | |
| WO | 2017153296 | A1 | 9/2017 | |

OTHER PUBLICATIONS

Navor: https://www.amazon.com/Portable-Carrying-Electronic-Accessories-Organizer/dp/B01MT7T4D0 (Year: 2017).*

Extended European Search Report for European Patent Application No. 20207997.6 dated Mar. 22, 2021, 8 pages.

* cited by examiner

LUGGAGE CASE WITH REMOVABLE STORAGE

CROSS-REFERENCE TO RELATED APPLICATION

This application claims priority to European Patent Application No. 20207997.6, filed Nov. 17, 2020 and entitled "Luggage Case With Removable Storage", which is hereby incorporated by reference herein in its entirety for all purposes.

FIELD

The present disclosure relates generally to removable pocket systems integrated into a luggage article.

BACKGROUND

Hard side luggage is a growing segment of the luggage market. Hard side luggage has certain advantages in durability and the ability to protect a user's belongings contained therein. However, hard side luggage typically has fewer options for additional pockets to store user belongings where the pockets are accessible without opening the main storage volume of the luggage case. Further, with the ubiquitous use of personal electronic devices such as smartphones, tablets, gaming consoles, laptops, and the like, there is a desire to store and easily access these devices and their accessories (e.g., spare batteries, power banks, chargers, cables, dongles, etc.) from a luggage case. Additionally, many airlines and national aviation regulatory agencies require that batteries not be packed in checked luggage of an airplane due to the risk of fire. Digging through a packed hard side case at a luggage check gate to retrieve a stowed battery can be a frustrating, embarrassing, and time-consuming experience.

EP3021705 B1 describes an auxiliary container that attaches to a front panel of a luggage case and protrudes outwardly from the luggage case increasing its overall size. The present disclosure seeks to alleviate, at least to a certain degree, the problems and/or address at least to a certain extent, the difficulties associated with the prior art. In particular, the present disclosure seeks to provide a hard side luggage case with a removable storage system that utilizes underutilized space in the luggage case and is easily accessible and removable from the luggage case without opening the main storage compartment.

SUMMARY

The present disclosure provides for a luggage article including a rear panel, a tow handle including a pair of spaced-apart tubes mounted on the rear panel, a recess defined between the tubes, and a removable pocket removably mountable in the recess between the tubes. The removable pocket and the recess include corresponding inter-engaging engagement features to at least partially retain the pocket within the recess.

Optionally, in some embodiments, an inter-engaging engagement feature of the pocket includes a rail feature, the inter-engaging engagement feature of the recess includes a track, and the rail feature is adapted to be received in the track feature to at least partially retain the pocket within the recess.

Optionally, in some embodiments, a removable pocket adapted to be fitted with the luggage article may also include the removable pocket includes an inter-engaging engagement feature adapted to be engaged with the inter-engaging engagement feature of the recess.

Optionally, in some embodiments, the pocket includes a main body with a plurality of panels forming an internal storage volume.

Optionally, in some embodiments, the luggage article may also include at least one panel of the plurality of panel made of a soft material.

Optionally, in some embodiments, the luggage article may also include at least one panel of the plurality of panel made of a hard material.

The luggage article may also include an external power interface coupled to a front panel of the plurality of panels, a power source including an internal power interface and disposed within the internal storage volume of the pocket, a cable in electrical communication with the internal power interface and the external power interface and operative to supply electrical power from the power source to the external power interface.

Optionally, in some embodiments, the recess is defined in the rear panel and at least a portion of a tow handle tube assembly including the pair of tubes is received in the recess.

Optionally, in some embodiments, the pair of tubes at least partially define the recess.

Optionally, in some embodiments, a track feature may be positioned in the recess and adapted to engage the rail feature of the pocket to retain the pocket within the recess. The track feature may create a seat in which the pocket snuggly fits. Such a seat may have the benefit of better securing a pocket within the recess by locking the pocket in at the narrower end of the recess. Another may be that the dimensions of the opposing rail features and/or track features may not need to be precise thereby allowing for increased manufacturability, lower costs, or higher quality inspection pass rates. Therefore, the storage system may be more tolerant of variations in the lateral dimension of the opposing rail features, such as due to manufacturing variations, deformation from use, or the like.

Optionally, in some embodiments, the removable pocket is slidably received in the recess.

Optionally, in some embodiments, the recess is on an external panel of the luggage article.

Optionally, in some embodiments, the pocket includes a closure mechanism that selectively exposes an opening to allow access to the internal storage volume of the pocket.

Optionally, in some embodiments, the pocket includes a strap on a rear panel of the pocket.

Optionally, in some embodiments, the pocket is adapted to receive a power source in the internal storage volume.

Optionally, in some embodiments, the luggage case includes a hard shell and the rear panel includes part of the hard shell.

Optionally, in some embodiments, the luggage article includes a plurality of wheels.

The present disclosure provides for a removable storage system for a luggage article including a pocket including a rail feature, a recess in an external panel of the luggage article, at least a portion of a tow handle tube assembly received in the recess, a track feature positioned in the recess. The rail feature is adapted to be slidably received in the track feature to removably coupleable to the pocket with the luggage article.

Optionally, in some embodiments, the pocket includes a plurality joined of panels, including at least opposing sidewalls, and a rear wall, that form an internal storage volume of the pocket.

Optionally, in some embodiments, the removable storage system of any of the preceding claims, where the rail feature includes a stiffener disposed within a hem positioned along a portion of the intersection of the sidewall and the rear wall of the pocket.

The removable storage system may also include where the stiffener is a wire. Other technical features may be readily apparent to one skilled in the art from the following figures, descriptions, and claims.

Optionally, in some embodiments, the removable storage system of any of the preceding claims, where the tow handle tube includes a retaining edge that protrudes in a lateral direction into the recess.

Optionally, in some embodiments, the removable storage system includes a cap disposed on an end of the tow handle tube, where the cap includes a curved shoulder adapted to facilitate the slidable engagement of the rail with the track feature.

Optionally, in some embodiments, the removable storage system includes a pair of tow handle tubes disposed at opposite lateral sides of the recess, where each tow handle tube of the pair of the tow handle tubes includes a retaining edge that protrudes in a lateral direction into the recess, a pair of track features are formed between the respective pair of retaining edges and a wall of the recess, and the rail feature includes opposing lateral portions, where each opposing lateral portion is slidably engagable with a respective one of the pair of track features.

Optionally, in some embodiments, the rail feature is adapted to be slidably received in the track feature to removably couple the pocket with the luggage article.

Optionally, in some embodiments, the pocket is removed by sliding the pocket out of an upper end of the recess.

Optionally, in some embodiments, the tow handle is selectively positionable between a retracted position and an extended position, where when the tow handle is in the retracted position, the tow handle is disposed above the pocket and retains the pocket within the recess. The restriction of the movement of the pocket in the recess by the grip handle conveniently keeps the pocket in place when stored in a luggage bin, on a luggage conveyor system, etc. The pocket may be easily extracted by slightly extending the grip handle and sliding the pocket 302 from the recess 102.

Optionally, in some embodiments, the rail feature may extend along at least a portion of a length of each opposing sidewall of the pocket.

Optionally, in some embodiments, the rail feature includes a wire loop extending around the entire periphery of the pocket.

Optionally, in some embodiments, the rail feature extends along the entire length of the pocket.

Optionally, in some embodiments, the rail feature includes discontinuous rail features spaced out along the length of the pocket.

Optionally, in some embodiments, the pocket also includes a fabric with a plastic backing. The plastic backing may include ethylene vinyl acetate.

Optionally, in some embodiments, the external power interface includes a USB interface.

Optionally, in some embodiments, a removable lid covers a portion of the external power interface.

Optionally, in some embodiments, a tether is coupled to the removable lid and one of the external power interface or the front panel and operative to retain the removable lid when the removable lid is removed from the external power interface.

Optionally, in some embodiments, a first track feature and a second track feature of the pair of track features tapers toward each other as the pair of track features extend from a second portion to a first portion of the recess.

Optionally, in some embodiments, the tow handle tube includes a pair of outer tow handle tubes, the storage system further includes a pair of inner tow handle tubes nested within a respective one of the outer tow handle tubes, a grip handle coupled to each of the inner tow handle tubes at opposite lateral ends of the grip handle, each retaining edge positioned along an edge of the respective outer tow handle tube closest to a rear wall of the recess.

Optionally, in some embodiments, when the grip handle is in the retracted position, the grip handle limits the slidable movement of the rail feature of the pocket along the track feature to prevent the pocket from being removed from the luggage article.

Optionally, in some embodiments, when the grip handle is in an extended position, the slidable engagement of the rail feature of the pocket along the track feature is uninhibited and the pocket is removable from the recess.

Optionally, in some embodiments, the internal storage volume of the pocket is suitable to contain a power source.

Optionally, in some embodiments, the removable storage system includes a power interface coupled to a front panel of the plurality of panels, a power source including an internal power interface and disposed within the internal storage volume of the pocket, a cable in electrical communication with the internal power interface and the external power interface and operative to supply electrical power from the power source to the external power interface.

Optionally, in some embodiments, the removable storage system includes a removable lid covering a portion of the external power interface.

Optionally, in some embodiments, a tether is coupled to the removable lid and one of the external power interface or the front panel and operative to retain the removable lid when the removable lid is removed from the external power interface.

BRIEF DESCRIPTION OF THE DRAWINGS

The description will be more fully understood with reference to the following figures in which components may not be drawn to scale, which are presented as various embodiments of the disclosure and should not be construed as a complete recitation of the scope of the disclosure, characterized in that.

DETAILED DESCRIPTION

Referring to FIGS. 1-8B, a luggage article 100 with removable storage system 300 according to an embodiment is disclosed. Traditionally, the space between the tow handle tubes of a luggage article is wasted, or under-utilized. The luggage 100 with a removable storage system 300 of the present disclosure make use of this otherwise wasted space to provide for an easily accessible and removable storage pocket. In one example, a removable storage system includes a pocket or pouch that is selectively receivable in a recess between tow handle tubes of the luggage article. The tow handle tubes are connected to a grip handle. The grip handle includes a locking mechanism that allows the tow handle tubes to be moved between a retracted and an extended position. The pocket includes a stiff rail adapted to be received with in a track formed between a portion of the tow handle tubes and a rear wall of the recess. The rail and the track form inter-engaging engagement features to at least partially retain the pocket within the recess. The rail may include two or more opposing rail features spaced laterally along sidewalls of the pocket. To insert the pocket into the recess, the locking mechanism of the grip handle is actuated, and the grip handle and tow handle tubes are moved to the extended position. The pocket may then be slidably received in the track by sliding the rail into the track. The pocket may be slid along the track into the recess. When the pocket is received in the recess, the locking mechanism of the grip handle may again be actuated and the tow handle tubes and grip handle lowered. When the grip handle is in the retracted position, the grip handle is disposed above the pocket and secures the pocket in the recess as the grip handle limits the slidable motion of the pocket within the track. In one example, the removable storage system includes a pocket including a rail feature. A recess is disposed in an external panel of the luggage article. At least a portion of a tow handle tube assembly is received in the recess. A track feature is positioned in the recess and the rail feature is adapted to be slidably received in the track feature to removably coupleable to the pocket with the luggage article.

Figure 1:
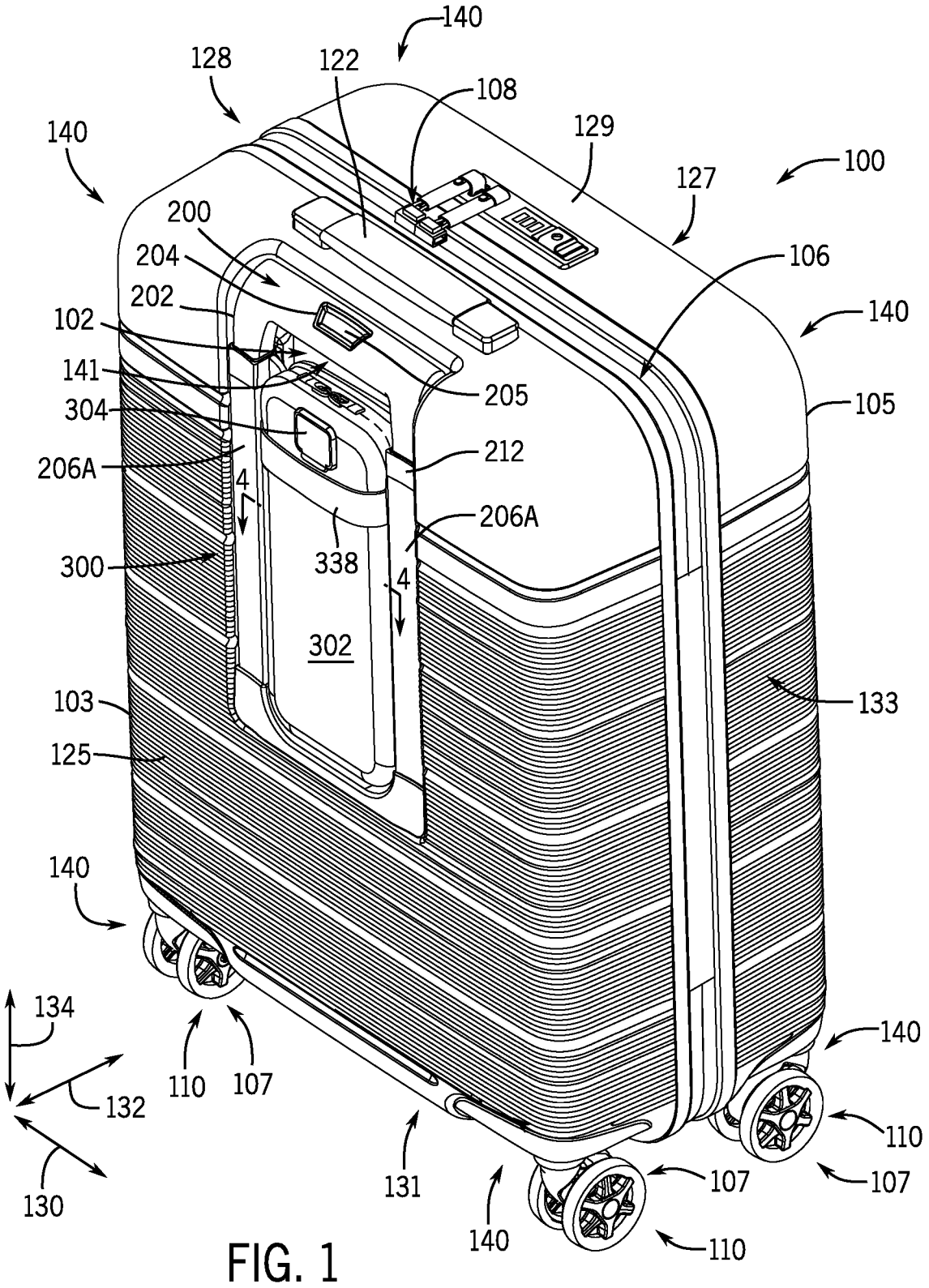
FIG. 1 is an isometric view of a luggage article including a removable storage system.

FIG. 1 is an isometric view of a luggage article 100 in a closed configuration. The luggage article 100 illustrated in FIG. 1 is an upright hard side case but may be many types of luggage, including a soft side case, a hybrid case, a container, or the like, but preferably is a hard shell type and/or at least includes a hard rear shell or more specifically a hard moulded rear panel to which the tow handle tubes are mounted. The luggage article has a plurality of panels defining an internal storage volume to carry a user's belongings. The luggage article 100 includes a front shell or lid 105 and a rear shell or base 103, which are selectively separable along a line of separation by a fastener, such as for example a zipper. The front shell or lid 105 and the rear shell or base 103 may be positioned adjacent one another in the closed configuration to enclose a user's belongings within the internal storage volume. The luggage article 100 may be configured in an open position with the lid 105 and the base 103 positioned apart from one another. The lid 105 and the base 103 may be pivotably attached together such as by a hinge 128 or similar mechanism. The lid 105 and the base 103 may be selectively coupleable to one another, such as by a closure 106. The closure 106 may be operated by a closure operator 108. In some examples, the closure 106 is a zipper and the closure operator 108 is a zipper pull. In some examples, the luggage article 100 may include one or more carry handles 122 and/or a retractable tow handle assembly 200 extendable from the rear panel 125 of the luggage article 100.

The luggage article 100, in the closed configuration, includes opposing front and rear panels 127, 125; top and bottom panels 129, 131 (a portion of each of front 105 and rear 103 shells); and opposing left and right side panels 133 (a portion of each of front 105 and rear 103 shells), 135. Corner regions 140 may be defined by the intersection of any two or three adjacent panels. Solely for clarity of discussion, directions may be defined relative to the luggage case. For example, a lateral direction 130 may be defined generally in a direction between the left panel 133 and right panel 135. A depth direction 132 may be defined in a direction generally between the rear panel 125 and the front panel 127. A vertical direction 134 may be defined between the bottom panel 131 and the top panel 129. The directions 130, 132, and 134 are illustrative in nature only and in no way limiting.

The luggage article 100 includes one or more support members 107 to support the luggage article 100 against a support surface (e.g., against the ground). The support members 107, are preferably spinner wheel assemblies, but may be a fixed wheel assembly, a foot, a post, a caster, or any combination thereof, may be associated with any suitable panel of the luggage article 100, e.g., the bottom panel 131. As shown, the luggage article 100 may include four support members 107. In the example shown, the support members are double-caster spinner assemblies 110. Wheel assemblies may assist in moving the luggage article over the support surface.

The luggage article 100 may include a tow handle assembly 200. The tow handle assembly 200 may include a grip handle 202. As shown for example in FIG. 1, the grip handle 202 may be coupled to tow handle tubes 206 at opposing ends of the grip handle 202. The tow handle assembly 200 may be positioned at least partially within a handle recess 141 in communication with the recess 102. The opposing tow handle tubes 206 may be positioned, respectively, along the opposing sidewalls 144, 146 of the first portion 148 of the recess 102, and attached to the walls of the recess 102. In some examples, the tow handle tubes 206 are mirrored about a centerline of the grip handle 202. The tow handle assembly 200 may include two or more tow handle tubes 206*a/b* that telescope with respect to each other. The telescoping tow handle tubes may include at least an outer tow handle tube 206*a* and an inner tow handle tube 206*b*. The inner tow handle tube 206*b* may nest within (telescope within) the outer tow handle tube 206*a*. In some examples, additional tow handle tubes, such as 206*c*, may be nested within the inner tow handle tube 206*b*. The inner tow handle tube 206*b* may retract into the outer tow handle tube 206*a* when the grip handle 202 is fully retracted and positioned in the second portion of the recess 102, as shown in FIG. 1. The grip handle 202, in an extended position (See FIG. 2), is located above the second portion of the recess 102. The grip handle 202 may be coupled to each of the inner tow handle tubes 206*b* and/or 206*c* at an opposite lateral end of the grip handle 202. A locking mechanism 204 may be operative to allow adjustment of the telescoping movement of the inner tow handle tubes 206*b/c* and the grip handle relative to the outer tow handle tubes 206*a*. An actuator 205 for the locking mechanism 204 may be associated with the grip handle 202 for control by a user.

Figure 2:
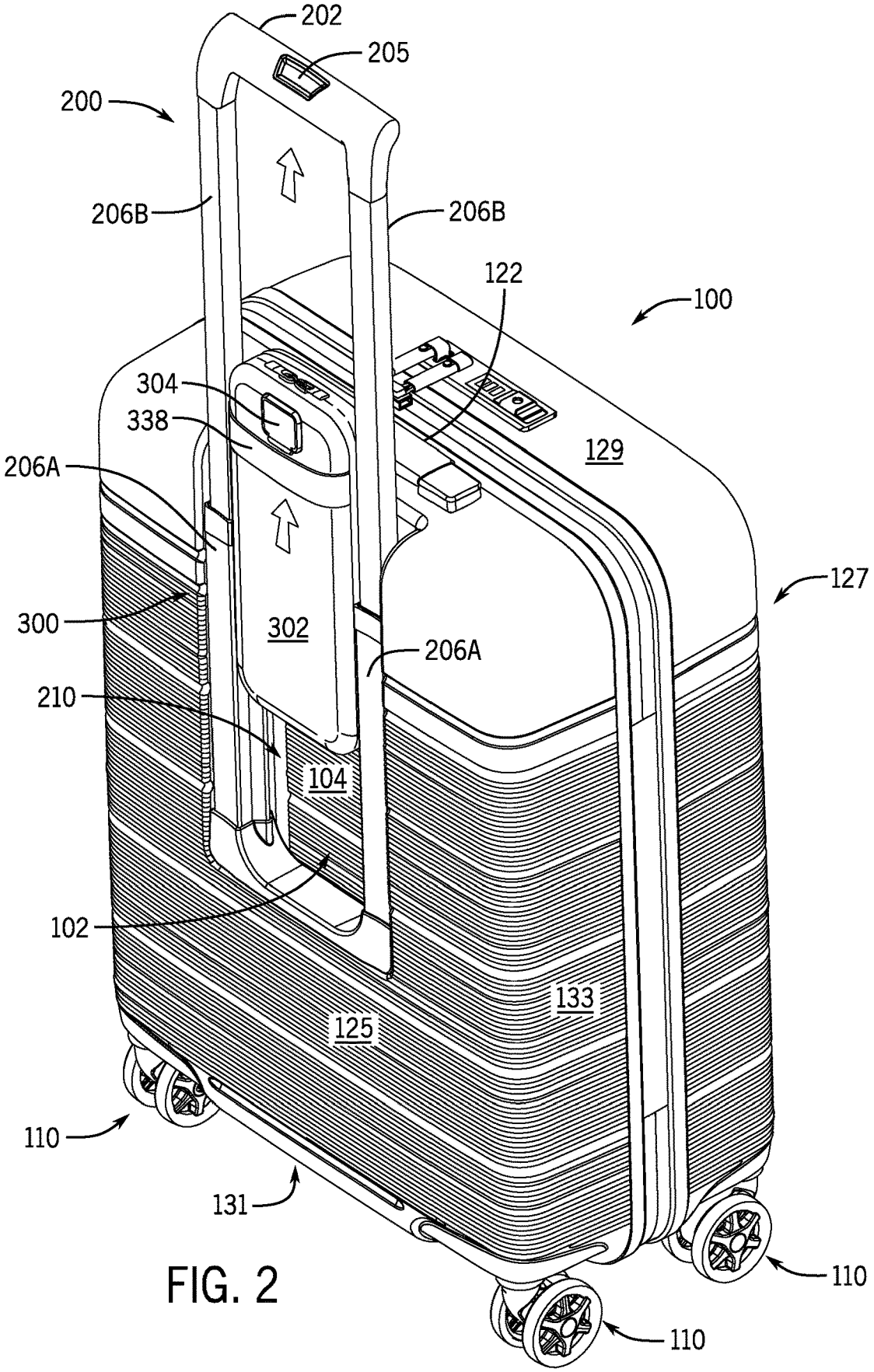
FIG. 2 is an isometric view of the luggage article of FIG. 1 with a pocket of the removable storage system in a partially removed configuration.
Figure 3:
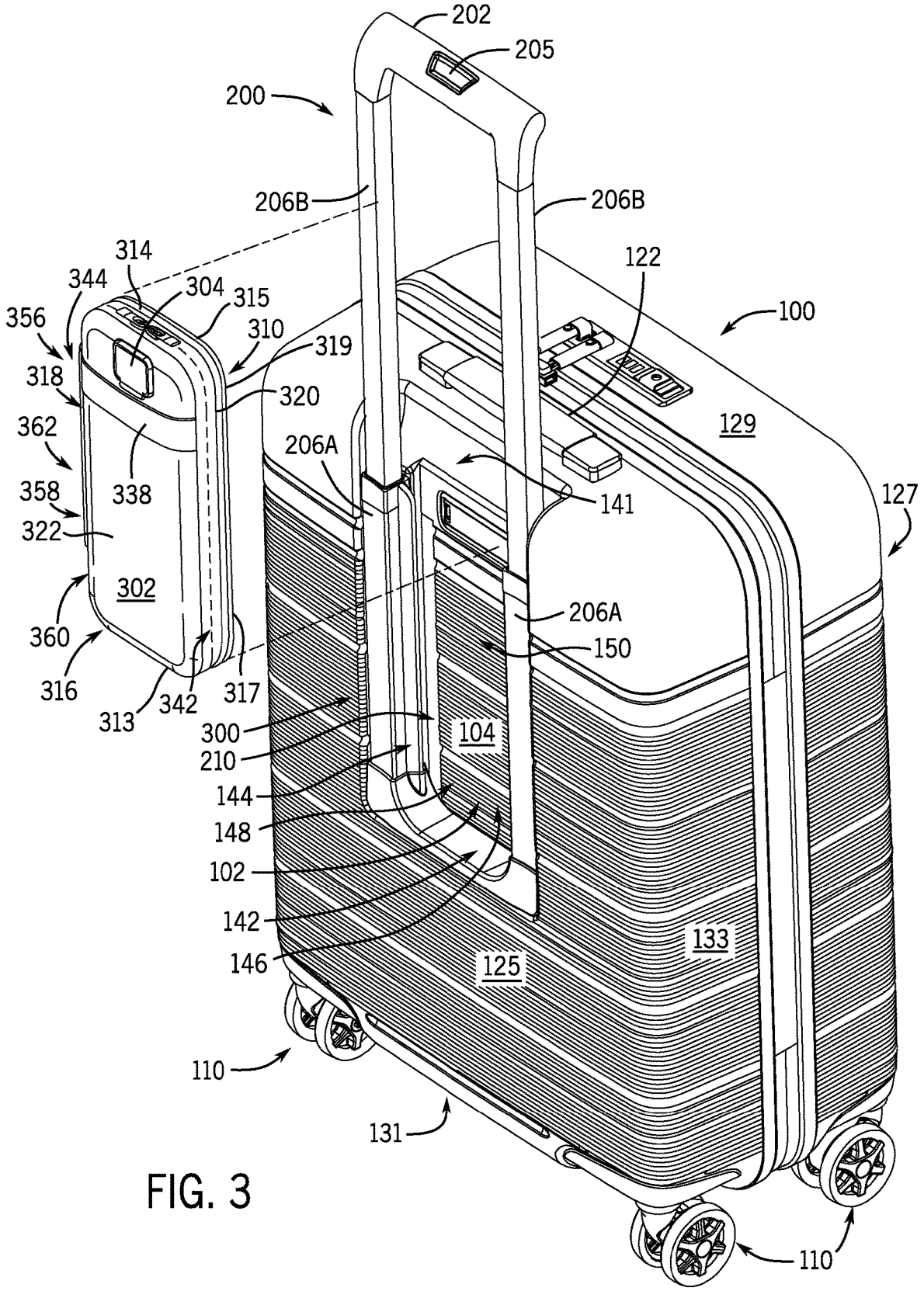
FIG. 3 is an isometric view of the luggage article of FIG. 1 with the pocket of the removable storage system in a fully removed configuration.

The luggage article 100 includes a tow handle assembly 200 comprising a pair of tow handle tubes 260 coupled to the base 103. The tow handle tubes 260 may be coupled to the rear panel 125. The luggage article 100 includes a recess 102 formed in a panel of the luggage article 100. In some embodiments, the panel including the recess may be an external panel of the luggage article 100. The recess may have a rear wall 104, a lower wall 142, and opposing left 144 and right 146 walls. The recess 102 may have a lower portion 148 near the lower wall 142. The recess 102 may have an upper portion 150 near the handle recess 141. The recess 102 may be formed in the rear panel 125, as shown in FIGS. 1-3. The recess 102 may be formed between the tow handle tubes 206. The tow handle tubes may at least partially define the recess 102. For example, the tow handle tubes 206 may form a portion of the opposing left 144 and right 146 walls. In some examples, the recess 102 may be external to the shell of the luggage article, such as when the tubes are coupled to an external surface of a panel of the luggage article and defining the recess 102 there between. The tow handle tubes 206 may be included in a tow handle tube assembly, a portion of which is received in the recess 102. In other examples, the recess 102 or may be a separate piece from a panel of the luggage article 100 that covers an opening formed in a panel of the luggage article 100. For example, the recess may be formed by a piece that is inserted into and covers an opening in the rear panel 125 of the luggage article. A removable pocket 302 may be received between the tow handle tubes 260 in the recess 102. The removable pocket 302 may be retained at least partially within the recess 102. In other examples, the recess may be formed in another panel. For example, the recess 102 may be formed in the top panel 129, the bottom panel 131, the left panel 133 and/or the right panel 135. The recess 102 may be adapted to receive portions of a tow handle assembly 200. The recess 102 includes a first portion 148 and a second portion 150. The first portion 148 is below the second portion 150. The first portion 148 is defined by a back wall 104 defining a depth of the first portion 148 of the recess, opposing sidewalls 144, 146 defining a width of the recess 102 and a bottom wall 142. The top portion 150 of the recess 102 is defined by a back wall 104 defining a depth of the second portion 150 of the recess 102, and opposing sidewalls 144, 146 defining a width of the second portion 150 of the recess 102. The depth of the first portion 148 is generally less than the depth of the second portion 150 of the recess. The second portion 150 of the recess 102 extends into the top panel 129. The recess 102 may be formed in the rear shell 103, and may primarily be formed in the rear panel 125, and in this example may be at least partially formed in the top panel 129. The recess 102 may be press-formed into the rear shell 103. The recess 102 may also be a separate structure positioned in the rear shell 103 to cover or fill in an aperture cut out of the rear shell 103 having the shape of the periphery of the recess 102.

Also shown in FIG. 1 is a removable storage system 300. The storage system 300 includes a pocket 302 removably positioned in the recess 102. The pocket 302 may include a rail adapted to be slidably received in a track feature 210 formed in the recess 102. In some examples, a rail may extend continuously along each of the opposing transverse sides of the pocket. Alternatively, in some examples, a rail may extend discontinuously along each of the opposing transverse sides of the pocket, such as by a plurality of segmented spaced-apart rail features positioned along each one of the opposing transverse sides of the pocket 302. The pocket 302 may be removably coupleable to the luggage article 100 by slidable engagement of the opposing rail features 310 with the track feature 210. The pocket 302 includes a main body 362 defining an internal storage volume 336, and having lateral peripheral edges 354. The main body 362 may have an upper portion 356, a central portion 358, and a lower portion 360 (shown for example in FIG. 3). The pocket 302 may include opposing top 314 and bottom 316 panels, opposing left 318 and right 320 side panels, and opposing front 324 and back 322 panels. Any of the respective panels of the pocket 302 may be selectively coupleable to another adjacent panel on the pocket, such that the pocket 302 may be opened to add or retrieve items. For example, the rear panel 322 and front panel 324 may be selectively secured to one another by a closure device 342 such as a hook-and-loop fastener, zipper, snaps, buttons, a hinge, or the like.

When the grip handle 202 is in a retracted position (shown for example in FIG. 1) the pocket 302 may be secured in the recess 102. For example, when the grip handle 202 is in the retracted position, the grip handle 202 may limit the slidable engagement of the opposing rail features 310 with the track feature 210 to prevent the pocket 302 from being removed from the luggage article 100. As shown for example in FIG. 2, the grip handle may be moved to an extended position and allowing the pocket 302 to be removed from the recess 102. For example, the pocket 302 may be removed from the recess by sliding it in a direction along the length of the recess 102 and through the open second portion of the recess 102. For example, the pocket may be removed from the recess by sliding the pocket out of the upper end 150 of the recess 102. In another example, the pocket may also pass through the handle recess 141 as it is removed from the recess 102. To facilitate installation and removal of the pocket 302 from the storage system 300, the pocket 302 may include a handle or strap 338 positioned on the rear panel 322 of the pocket 302. In some examples, the handle 338 may be formed in the rear panel 322, such as a hand hold or grip. FIG. 2 shows the pocket 302 in a partially removed state. FIG. 3 shows the pocket 302 fully removed from the recess 102.

Figure 4A:
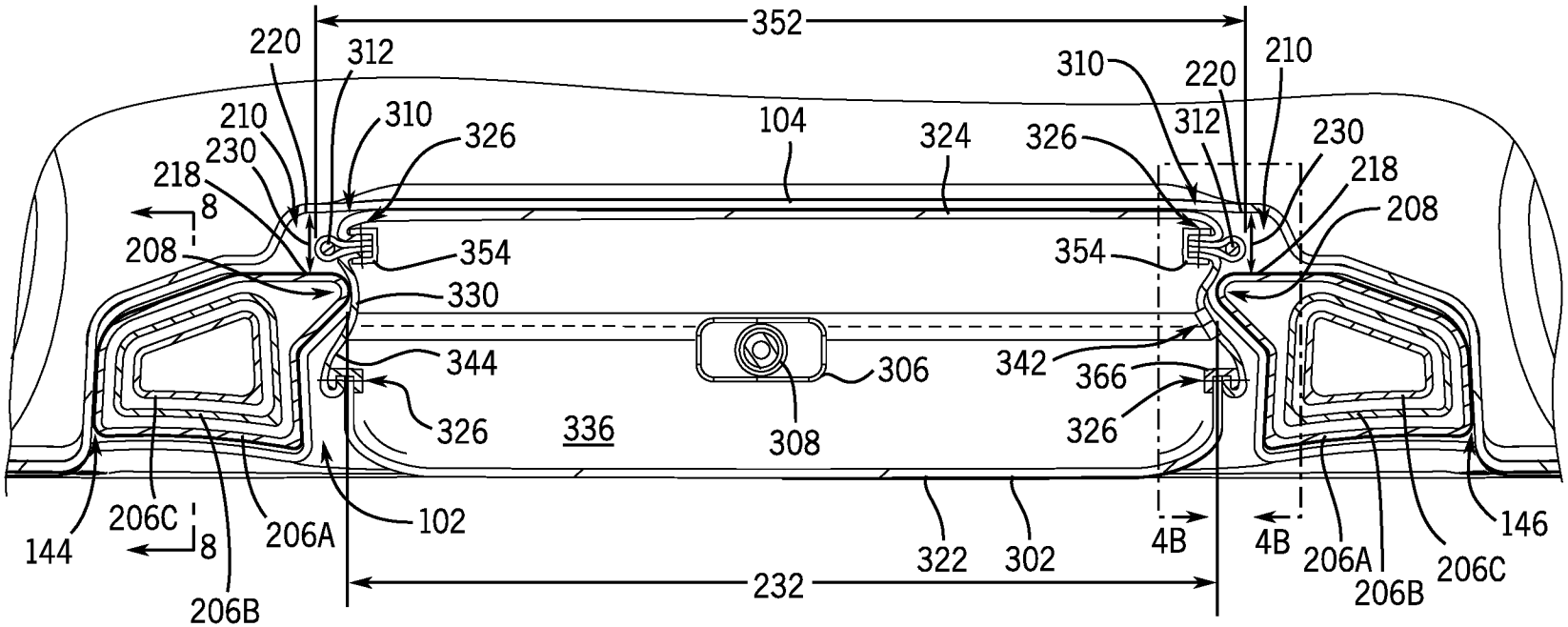
FIG. 4A is a cross section of the luggage article 100 taken along line 4-4 of FIG. 1.
Figure 4B:
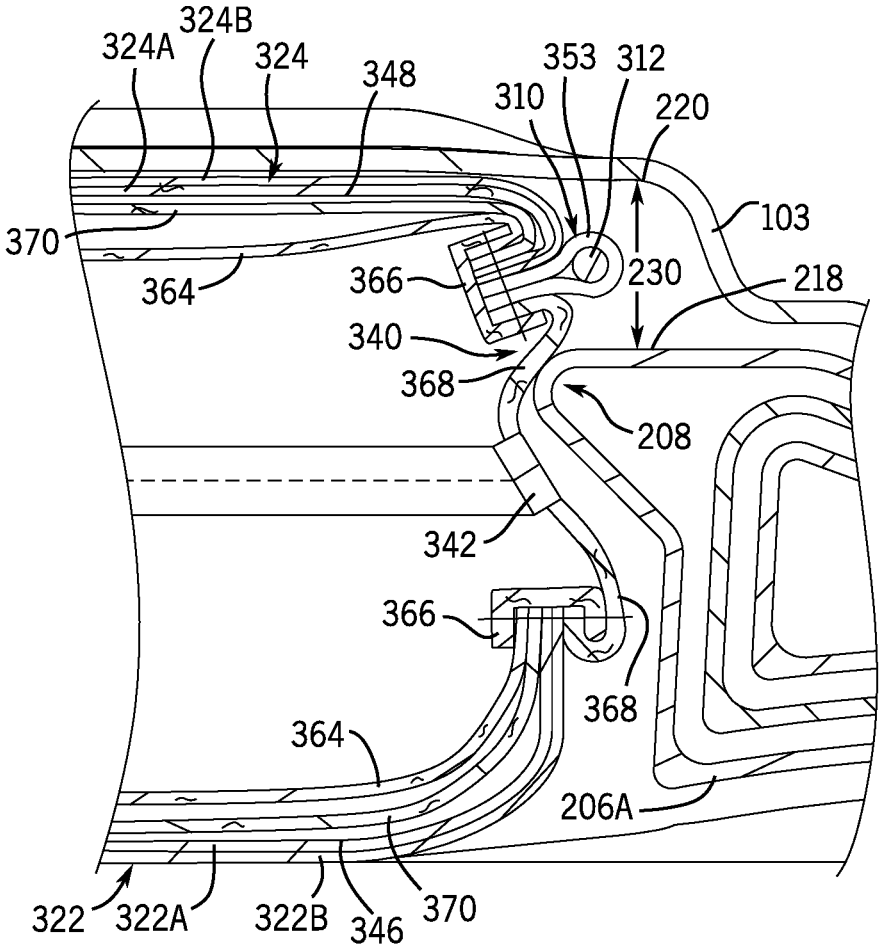
FIG. 4B is a detail view of FIG. 4A taken at line 4B-4B of FIG. 4A.

FIG. 4A is a cross section of the luggage article 100 taken along line 4-4 of FIG. 1. A detail of a portion of FIG. 4A is shown in FIG. 4B. The tow handle assembly 200 may be adapted to receive and retain the pocket 302. For example, as shown in FIGS. 4A-4B, a track feature 210 may be formed in the luggage article 100 to receive the rail 310. The rail may include opposing rail features 310 of the pocket 302. The opposing rail features 310 may be disposed on portions of opposing side walls 318, 320 of the pocket 302. When the pocket 302 is received in the recess 102 by the opposing rail features 310 being received in the track features 210, the opposing rail features 310 engage the rear wall 104 of the recess 102 and retaining edges 208. The opposing rail features 310 may have a snug fit within the track features 210 to help retain the pocket 302 within the recess 102. The track feature 210 may be positioned between a wall of the recess 102 and a tow handle tube 206 of the luggage article 100. In some examples the track features 210 may be formed in opposing side walls 144, 146 of the recess 102. In some examples, track features 210 may be formed partially by a gap between the tow handle tubes 206 and the wall 104 of the recess 102 and partially as a feature of the side walls 144, 146 of the recess 102 irrespective of the tow handle tubes 206. For example, the track feature 210 may be defined between the rear wall 104 of the recess 102 and a tow handle tube 206. A outer portion 218 of the track feature 210 may be formed by the outer tow handle tube 206*a*. A rear portion 220 of the track 210 may be formed by the back wall 104 of the recess 102. For example, the rear portion 220 of the track 210 may be formed by the wall 104 of the recess 102 extending in a plane along the vertical direction 134 and the lateral direction 130. In some examples, the outer tow handle tube 206*a* may include a retaining edge 208 that extends outwardly from the tow handle tube 206*a* in the lateral direction 130 into the recess 102. In this example, each of the pair of tow handle tubes 206 may include a retaining edge 208 that extends in the lateral direction 130 into the recess 102 to reduce the dimension of the gap between the tow handle tubes 206. In some examples, a transverse dimension 232 between the retaining edges 208 is less than a transverse dimension 352 between the opposing rail features 310. The track feature 210 may be formed from other structures, such as a retaining edge formed in a portion of the rear panel 125 or a portion of the wall 104 of the recess 102.

In some examples, the luggage article 100 may not include a recess 102 and a track feature 210 may be formed in a portion of a panel of the luggage article 100 (e.g., the rear panel 125). In some examples, the luggage article 100 may not include a recess 102 and a track feature 210 may be formed in a portion of one or more tow handle tubes 206 of the luggage article 100. In some examples, the luggage article 100 may not include a recess 102 and a track feature 210 may be formed partially in a portion of a panel of the luggage article 100 and partially in one or more tow handle tubes 206 of the luggage article 100. In such examples, opposing rail features of a pocket 302 may be selectively received in the track feature 210 as previously described and the pocket 302 may not be recessed in, or flush with, the respective panel of the luggage article 100 on which the pocket is positioned.

In some examples, the track feature 210 may be formed in a housing that surrounds a tow handle tube 206. The tow handle tubes 306 of the tow handle assembly may be fitted inside of the housing. For example, the housing may be integrated into a panel of the luggage article 100, e.g., the rear panel 125. A portion of the track feature 210 may be moulded or otherwise formed in the housing. In some examples, the housing forming the track feature 210 may be a separate piece attached or joined to a panel of the luggage article 100. Such a housing may allow easier forming of the track feature 210 such as by injection moulding, vacuum forming, or other suitable processes.

The track feature 210 may have a depth 230 defined between the outer portion 218 and the rear portion 220. In some examples, the depth 230 may be slightly smaller than a thickness dimension 350 of the opposing rail features 310 (shown for example in FIG. 5G). In other examples, the depth 230 may be about the same size as the thickness dimension of the opposing rail features 310. In other examples, the depth 230 may be larger than the thickness dimension of the opposing rail features 310. In some examples, the depth 230 may vary in the vertical direction 134. For example, the depth 230 may be larger near an upper portion of the track feature 210 than the depth 230 at near the lower portion of the track feature 210. The depth 230 of the track portion 210 may vary smoothly from thicker to thinner depths along the vertical direction 134. In some examples, the depth 230 may vary in the transverse direction 130. For example, the depth 230 may be narrower near a side wall 144, 146 of the recess 102 than the depth 230 is farther away from the side wall 144, 146 toward the interior of the recess 102. In another example, the depth 230 may be wider near a side wall 144, 146 of the recess 102 than the depth 230 is farther away from the side wall 144, 146 toward the interior of the recess 102.

The retaining edge 208 may form the outer portion 218 of the track feature 210. In some examples, a pair of track features 210 are formed between the opposing pair of retaining edges 208 and the respective back wall 104 of the recess 102. In some examples, the retaining edge 208 may run the length of the tow handle tube 206*a*. In some examples, the retaining edge may be one of a plurality of retaining edges spaced along at least a portion of the length of the tow handle tube 206*a*. In the examples shown, the retaining edges 208 run substantially parallel with one another. In other examples, the retaining edges 208 on opposite lateral sides of the recess 102 may be tapered toward one another in the lateral direction 130. The tracks 210 may be tapered in a direction toward one another, for instance spaced transversely closer to one another at a bottom of the tracks 210 than at the top of the tracks 210. For example, a first track 210 of the pair of tracks may be tapered toward a second track 210 of the pair of tracks in the lateral direction 130. For example, retaining edges 208 at opposite lateral sides of the recess 102 may be closer to one another at one end of the recess 102 (e.g., at a bottom end) than they are at another end of the recess 102 (e.g., the top of the recess). A lateral taper may create a "seat" into which the pocket 302 snuggly fits. Such lateral tapering may have the benefit of better securing a pocket 302 within the recess 102 by locking the pocket 302 in at the narrower end of the recess 102. Another benefit of lateral tapering may be that the dimensions of the opposing rail features 310 and/or track features 210 may not need to be precise thereby allowing for increased manufacturability, lower costs, or higher quality inspection pass rates. Therefore, the storage system 300 may be more tolerant of variations in the lateral dimension 352 of the opposing rail features 310, such as due to manufacturing variations, deformation from use, or the like.

In other examples, the track 210 may be tapered in the depth direction 132. For example, the track 210 may be narrower at one end of the recess 102 (e.g., the bottom end) than it is at another end (e.g., the top end). Such depth tapering may be achieved by forming the retaining edges 208 such that they are closer to the rear wall 104 of the recess 102 at the lower portion 148 of the recess 102 than at an upper top portion 150. Likewise, depth tapering may be achieved by forming the rear wall 104 such that at a lower portion 148 of the recess 102 the wall 104 extends in the depth direction 132 away from the front panel 127. For example, a ramp may be formed in the recess 102 by angling the wall 104, with respect to the tow handle tubes 206. For example, the wall 104 may be ramped in the depth direction 132 while the tow handle tubes 206 extend in the vertical direction 134. In another example, the wall 104 may extend in the vertical direction 134 while the tow handle tubes 206 ramp in the depth direction 132 In other examples, both the tow handle tubes 206 and the wall 104 may ramp in the depth direction, wither toward or away from one another along the vertical direction 134.

FIGS. 5A-5D show an embodiment of a pocket 302A suitable for use with the storage system 300. The pocket 302A includes a main body 362. The main body 362 may have an upper portion 356, a central portion 358, and a lower portion 360 (shown for example in FIG. 3). The pocket 302A may include opposing top 314 and bottom 316 panels, opposing left 318 and right 320 side panels, and opposing front 324 and back 322 panels. A rail feature 310 extends around at least a portion of the peripheral lateral edge 354 of the pocket 302A. In some examples, the rail feature 310 extends around the entire peripheral edge of the pocket 302A. For example, the rail may include a wire loop that extends around the entire peripheral edge of the pocket. In some examples, the rail feature may extend only along all of or just part of the length of the lateral edges of the pocket, and not along the of the top panel 314 or the bottom panel 316 since they may not engage the track features. The pocket includes a leading end 313, which is the end defined by the bottom panel 316 of the pocket, which enters the recess 102 first as the pocket 302 is inserted into the recess 102. The ends of the rail features 310 adjacent the leading end 313 may define a leading edge 317 suitable to initiate engagement of the respective rail 310 with the opposing track features 210. The pocket includes a trailing end 315, which is the end defined by the top panel 314 of the pocket, which is positioned at the top of the recess 102 after the pocket is fully inserted into the recess. The ends of the rail features 310 adjacent the trailing end 315 may define a trailing edge 319 that may be disposed, respectively, at the top of the opposing track portions 210 when the pocket 302A is inserted in the recess 102.

Figure 5A:
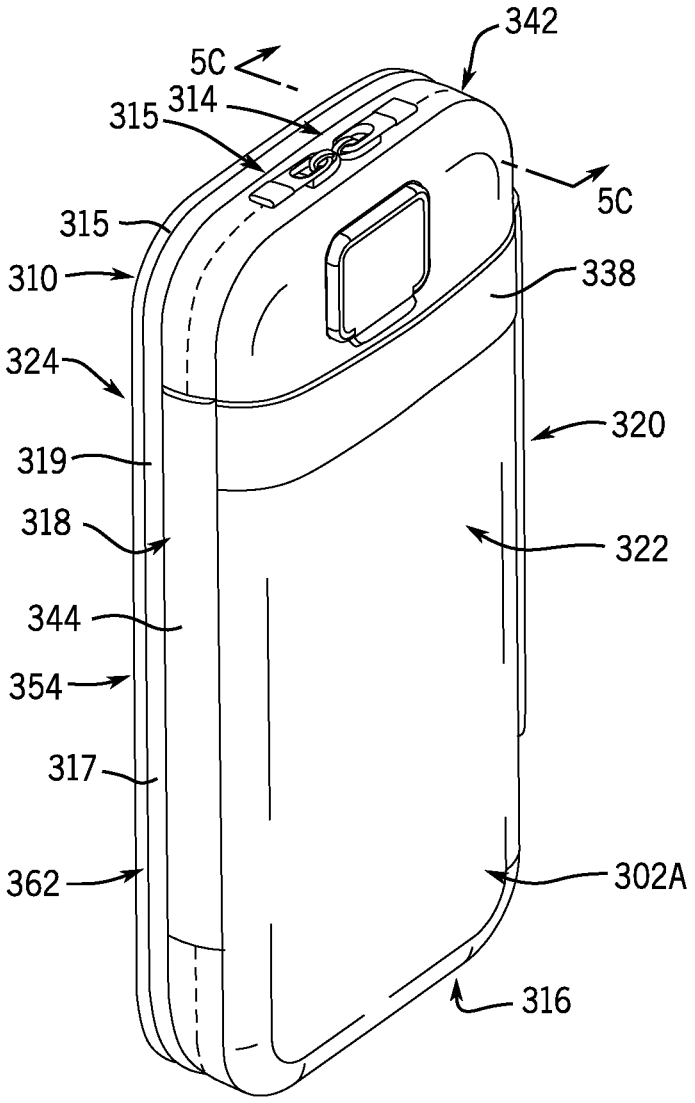
FIG. 5A an isometric view of a pocket of the removable storage system of FIG. 1 in a closed configuration.
Figure 5B:
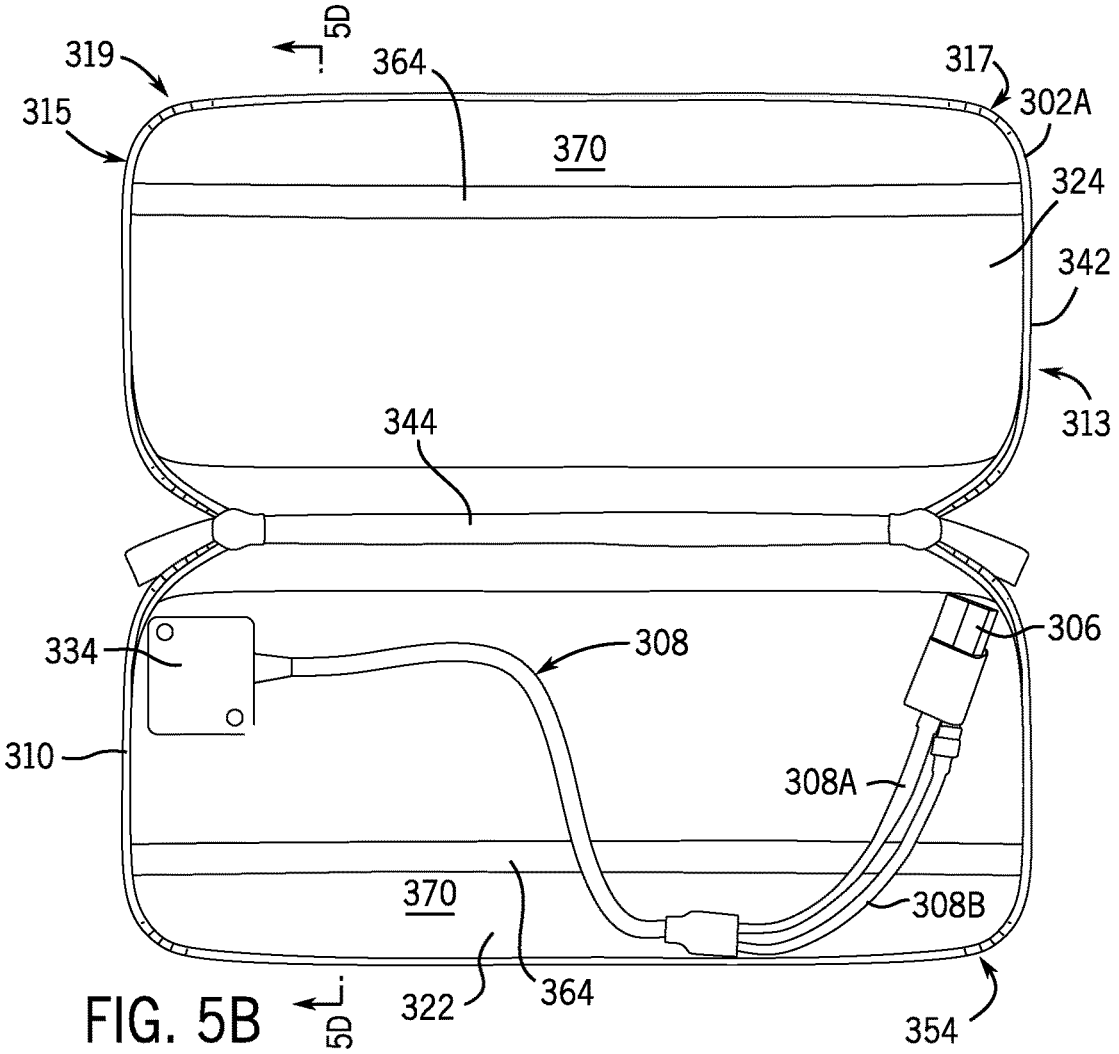
FIG. 5B plan view of the pocket of FIG. 5A in an open configuration.

The pocket may include a closure device 342 that selectively exposes an opening to allow access to the interior compartment of the pocket. The closure device 342 may be positioned on the front panel 324, top panel 314, opposing lateral side panels 318, 320, or a combination of more than one of these panels. In one example, the front panel 324 and back panel 322 may be selectively joined by a closure device 342 that selectively exposes an opening into the pocket 302. In some examples, the closure device 342 may partially or entirely replace the top panel of the pocket. In the example shown, the closure device 342 is a zipper. In other examples, the closure device 342 may be buttons, snaps, a hook and loop fastener, or the like. As best shown in FIG. 5B, the closure device 342 may extend around at least a portion of the peripheral lateral edge 354 of the pocket 302A. The front panel 324 and back panel 322 are joined at the left panel 218 by a hinge 344. Thus, when the closure device 342 is configured to an open position as shown for example in FIG. 3B, the front panel 324 and back panel 322 may be separated from one another to access the interior storage volume 336 of the pocket 302A. For example, the front panel 324 and back panel 322 may be separated from one another to expose an inner surface of the front panel 346 and an inner surface of the rear panel 348. Inner pouches 364 may be disposed on the inner surfaces 346 and/or 348.

A cable 308 may include more than one cable portion, such as a cable portion 308A and cable portion 308B which may be provided with different internal power interfaces 306 in electrical communication therewith. For example, the cable portion 308A may include a USB A power interface. The cable portion 308B may include a mini-USB or micro USB power interface.

Figure 5C:
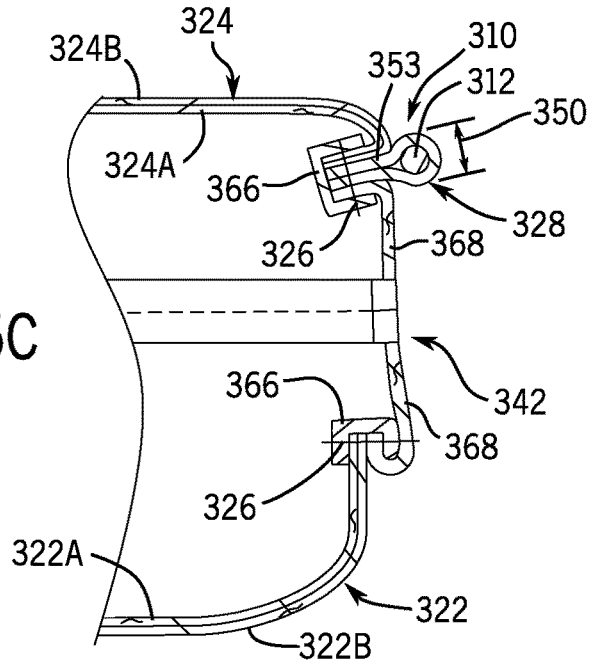
FIG. 5C a partial section view of the pocket of FIG. 5A taken along section line 5C-5C of FIG. 5A.
Figure 5D:
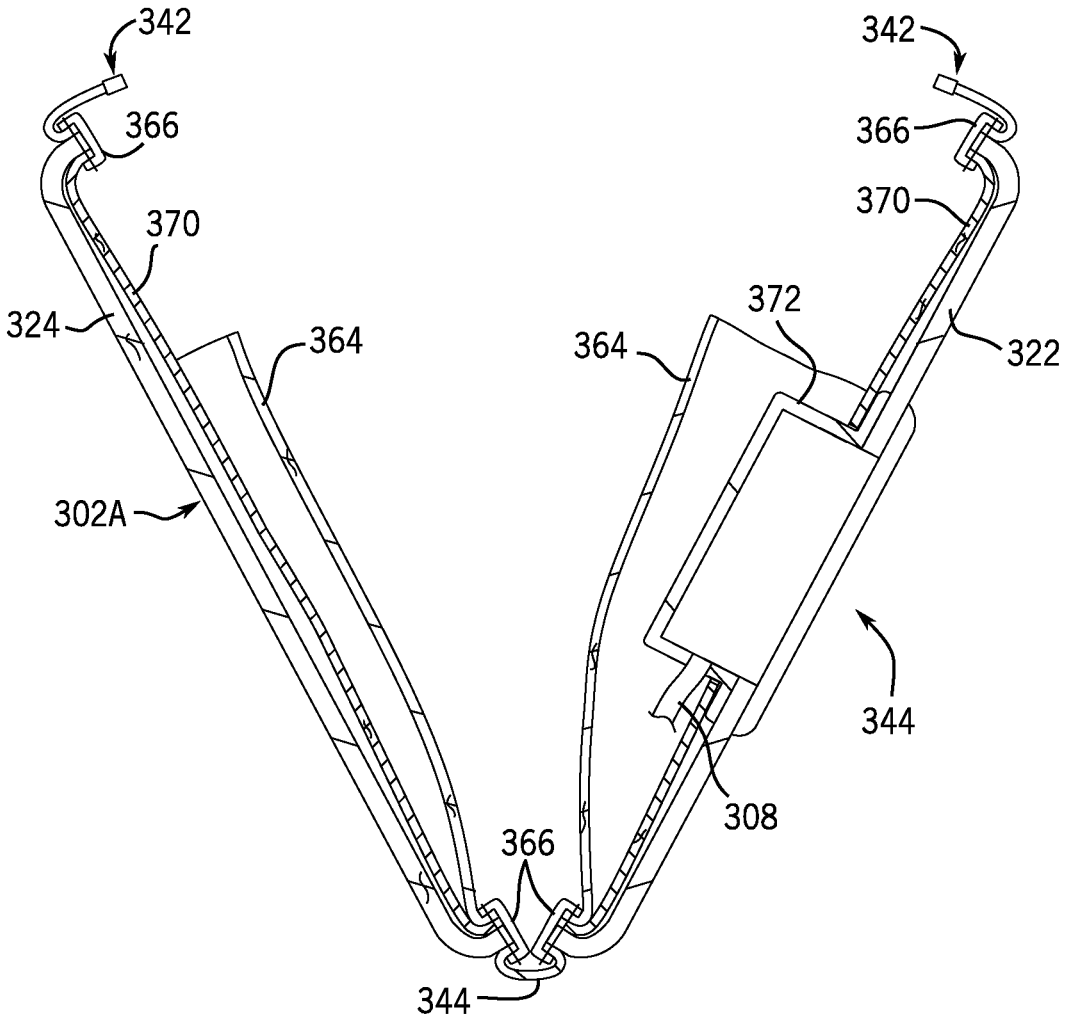
FIG. 5D is a section view of the pocket of FIG. 5A taken along section line 5D-5D of FIG. 5B and shown in a partially open configuration.

FIG. 5C shows a cross section of the pocket 302A with the liner 370 removed, for clarity. The front panel 324 and/or the rear panel 322 may be formed of fabric with an ethylene-vinyl acetate (EVA) backing. For example, the rear panel 322 may include a layer of fabric 322B joined to a layer 322A of EVA or other suitable plastic. Similarly, the front panel 324 may include a layer of fabric 324B joined to a layer 324A of EVA or other suitable plastic. The shape of the front panel 324 may be formed by a molding step to create a 3-dimensional shape that creates a defined volume in the pocket even when it is empty. The 3-dimensional molded shape also may allow at least a portion of the front panel 324 to be flush with the rear face of the rear shell of the luggage case. The front panel 324 may be below flush or above flush also, depending on the intended interior volume for storage of the pocket. The rear panel may also have a formed shape, such as by a mold, if desired. The positions of the layers 324A/B and/or 322A/B may be as shown, such that the plastic layer may be toward the internal storage volume 336 of the pocket 302A with the fabric layer toward the outside of the pocket 302A, as shown. The positions of the layers 324A/B and/or 322A/B may be switched, such that the fabric layer may be toward the internal storage volume 336 of the pocket 302A with the plastic layer toward the outside of the pocket 302A.

Referring still to FIG. 5C, the front panel 324 and rear panel 322 may be joined with the selective closure device 342 and the rail 310, as shown. The stiffener 312 may be wrapped longitudinally with a portion of piping 353. The closure device 342 may include a tape portion 368 suitable to attach the closure device 342 to the pocket 302A. The tape portion 368 may be a cloth or membrane. The overlapping edges of the piping 353 may be sandwiched between the tape portion 368 and the front panel 324. A cover portion 366 may be placed over both sides of the sandwich of piping 353, the tape portion 368, and the front panel 324 and joined with a stitch 326 to form a hem 328 and the rail 310. Similarly, another tape portion 368 of the closure device 342 may be sandwiched with the rear panel 366 with a cover portion 366 placed over both sides and secured with a stitch 326. A liner 370 and/or pouch 364 may be included in the sandwiched structure with the front panel, rear panel, and tape portions (shown for example in FIGS. 4A and 4B).

Figure 5E:
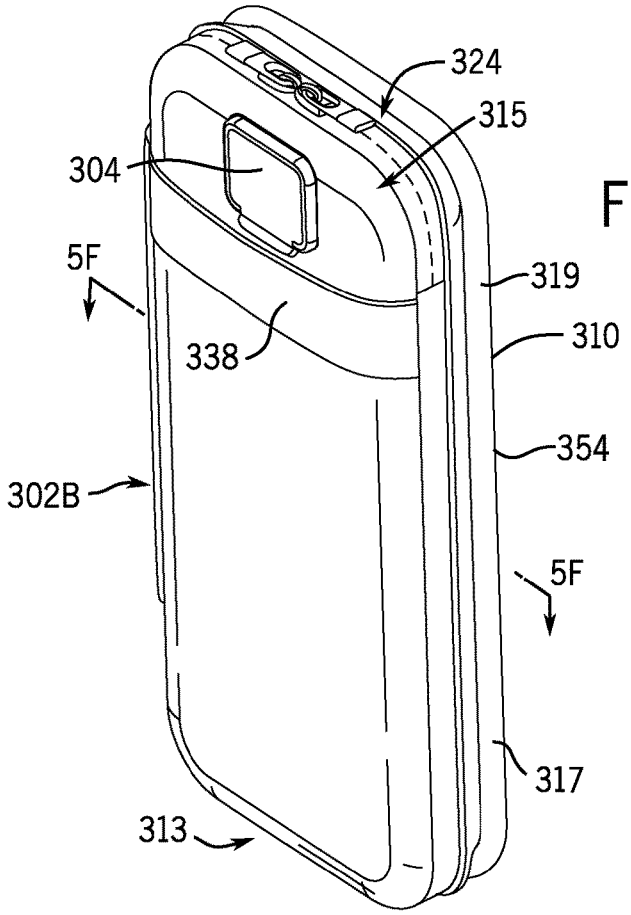
FIG. 5E is an isometric view of a pocket of the removable storage system of FIG. 1.
Figure 5F:
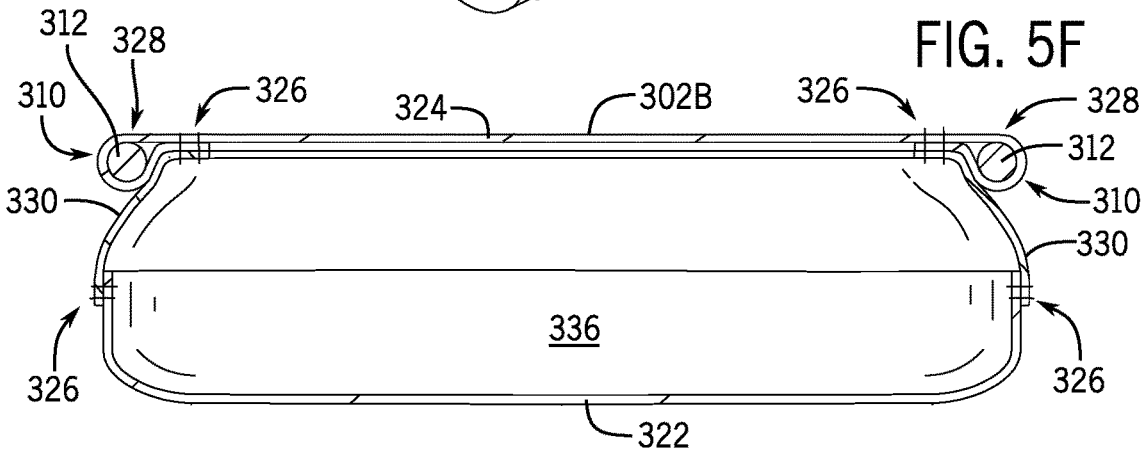
FIG. 5F is a cross section of the pocket of FIG. 5E taken along section line 5F-5F of FIG. 5E.
Figure 5G:
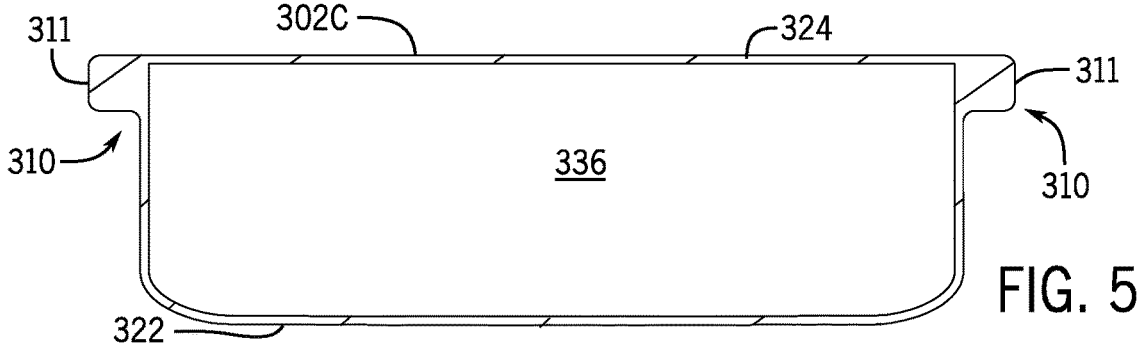
FIG. 5G is a section of an example of a pocket of the removable storage system of FIG. 1 taken along section line 5B-5B of FIG. 5A.

With reference to FIGS. 5E-5F-5G, an example of a pocket 302B may include opposing rail features 310. The opposing rail features 310 may be adapted to be selectively received within the track 210. The opposing rail features 310 may be positioned on the pocket 302 and spaced from one another at a dimension 352 greater than the dimension 232 between opposing retaining edges 208 are spaced apart. The opposing rail features 310 may be on at least a portion of the peripheral lateral edge 354 of pocket 302. The opposing rail features 310 may be positioned at intersection of the front panel 324 of the pocket 302 and opposing lateral sidewalls 318, 320. In some examples, the opposing rail features 310 may be positioned anywhere along sidewalls of the pocket 302. In some examples, the opposing rail features 310 may be positioned on front panel 324 of the pocket 302 only. In the examples 302A and 302B shown, the opposing rail features 310 are positioned on at least a portion of the side or edge 354 formed between front panel 324 and opposing sidewalls 318, 320. Opposing sidewalls 318, 320 may be considered transversely spaced from one another across the width of the pocket 302. Such a position may keep the pocket 302A/B adjacent to the rear wall 104 of the recess 102 and keep the rear panel 322 of the pocket 302A/B flush with the rear panel 125 of the luggage case 100. In other examples, the depth relationship between the opposing rail features 310 and the track features 310 may cause the rear panel 322 of the pocket 302 to be recessed below the rear panel 125 of the luggage case 100. In other examples, the depth relationship between the opposing rail features 310 and the track features 310 may cause the rear panel 322 of the pocket 302 to protrude proud of the rear panel 125 of the luggage case 100. Each opposing lateral rail feature 310 may be slidably engagable with a respective one of the pair of tracks 210.

The front panel 324 and the rear panel 322 of the pocket 302B may be selectively joined by a closure device 342, such as a zipper, in a portion of the top panel 314 extending to respective portions of the left panel 318 and right panel 320. The rear panel 322 may include a strap or handle 338 as previously discussed.

As shown in one example in FIG. 5G, the opposing rail features 310 may be formed by a linearly extending member or plurality of discrete members having an effective length sufficient to engage with the track feature and secure the pocket from disengaging with the opposing rail features 310 through the gap between the opposing rail features 310. The opposing rail features 310 may be relatively stiff or rigid to secure the pocket 302 into the track 210. In the example shown in FIG. 5C, the opposing rail features 310 are formed by a rib or piping structure positioned around at least a portion the periphery 354 of the pocket at the intersection of the back wall and the opposing side walls of the pocket. The piping structure includes a stiffener 312, such as steel wire. The stiffener 312 may be disposed within a hem 328 formed between two adjacent panels of the plurality of panels of the pocket 302. For example, the rail features 310 may include a hem 328 formed by a portion of the front panel 324 wrapped over the wire 312, folded onto itself and stitched to itself and to the bridge portion 330 by sewing stitches 326. In other examples, the hem 328 may be secured with adhesives, by welding, rivets, or other suitable methods instead of, or in addition to, the stitches 326. For example, the method of forming the hem 328 may depend upon the materials of the rear panel 322, the front panel 324, the stiffener 312, or the like. The stiffener may be made of a resilient material such as steel, thermoplastic, a fiber-reinforced composite, or the like.

One example of a pocket 302C is shown in FIG. 5G. The pocket 302C may include a rear panel 322 made from a hard material such as plastic, metal, wood, or the like. The pocket 302C may include a front panel 324 made from a soft material such as fabric, cloth, leather, plastic, or the like. The rear panel 322 and front panel 324 may be coupled by a bridge portion 330 that may be the same material as either the rear panel 322, the front panel 324, or another material. In other examples, the rear panel 322, the front panel 324, and/or the bridge portion 330 may be formed of any suitable hard or soft material. For example, the front panel 324 and/or the rear panel 322 may be formed of fabric with an ethylene-vinyl acetate backing. In other examples, the panels may be formed of suitable plastics such as polypropylene, polyethylene, or the like. The rear panel 322 and the front panel 324 may be joined to the bridge portion by sewing stitches 326.

The pocket 302C may include a main body 362 defining opposing sidewalls 318, 320, with rail features 310 positioned along at least a portion of the sidewalls similar to the other rail features described herein. The main body 362 of the pocket 302 in this example may be entirely or at least partially formed by a molding process, such as for example plastic injection molding, vacuum molding, or another type of molding. Where at least the sidewall portion of the pocket is a molded component, the rail features may be integrally or unitarily formed with the molded sidewalls of the pocket. For example, the rail features 310 may be a pair of opposing flanges 311 that each extend in the laterally outward direction 130 from the respective left or right panels 318, 320 of the pocket 302C. In some examples, the rail features 310 may be elongated and extend along the majority of or the entire length of the pocket 302. In some examples, the rail features 310 may be a plurality of discrete or discontinuous and spaced-apart segments that extend along a portion of a respective transverse edge along the at least a portion or the entire length of the pocket. The thickness dimension of each rail feature 310 is sufficient to be received within the respective track features 210, and may be consistent along the length of the pocket 302, or may change in thickness to enhance the engagement with the rail features 310. For instance, the rail feature 310 may have a thickness that is relatively thinner at the bottom of the pocket (e.g., near the bottom panel 316) than at the top of the pocket (e.g., near the top panel 314). In some examples, the track features 210 may not engage front and back portions of rail features 310 at the bottom of the track 210, and may fit snugly at the top portion of the rail features 310, for example to enhance insertion and retraction of the pocket 302 from the recess 102.

Referring back to FIG. 4A-4B, the rail features 310 of any pocket 302 disclosed herein may be selectively received in the track 210 to secure the pocket 302 in the recess 102. For example, a lower end of the rail features 310 of the pocket 302C may be inserted into the track 210 at the top portion 150 of the recess 102 and slid along the track features 210. The pocket 302C may be fully received within the recess 102 and one end of the pocket 302 (e.g., the bottom panel 316) is adjacent the bottom wall 142 of the recess 102. As the rail features 310 are slid along the track features 210, the retaining edges 208 may form an indentation 340 in the pocket 302 such that the rail features 310 engages with the tracks 210. For example, as shown in FIG. 4A-4B, opposing retaining edges 208 at opposite lateral sides of the recess 102 may be spaced apart a dimension 232 that is less than a dimension 352 between the rail features 310 at opposing sides 318, 320 of the pocket 302. The pocket 302 may be retained in the recess 102 by the relatively smaller dimension 232 with respect to the dimension 352. The pocket 302 may also secondarily be retained in the recess 102 by an engagement/pinching effect of the retaining edge 208 on the side wall 318, 320 of the pocket 302, forming the indentation 340. For example, the rail feature 310 may be secured between the retaining edge 208 and the rear panel 125 of the luggage article. For example, the rail features 310 may be secured between the retaining edge and the wall 104 of the recess 102. Similarly, where pocket 302C is at least partially formed of hard materials and includes integrally-formed rail features 310, such as the pair of opposing flanges 311 referenced above, the rail features 310 may be moved or slid along the track 210 until the pocket 302 is fully received in the recess 102.

By the slidable engagement of the rail features 310 with the track 210, the pocket 302 may be secured in the recess 102 such that the pocket may not be pulled rearwardly through the gap formed between the retaining edges 208 (e.g., the gap along the dimension 232 of FIGS. 4 A-4B) along length of recess 102 (e.g., in the depth direction 132, out of the recess 102). The grip handle 202 may serve to secure the pocket 302 in the recess 102 when the grip handle 202 is in a retracted position (See FIG. 1). In this position the grip handle 202 blocks the open second portion of the recess 102, and restricts movement of the pocket 302 along the track features 210 sufficient to remove the pocket 302 from the recess 102. The restriction of the movement of the pocket 302 in the recess 102 by the grip handle 202 conveniently keeps the pocket 302 in place when stored in a luggage bin, on a luggage conveyor system, etc. The pocket 302 may be easily extracted by slightly extending the grip handle 202 and sliding the pocket 302 from the recess 102.

Figure 6:
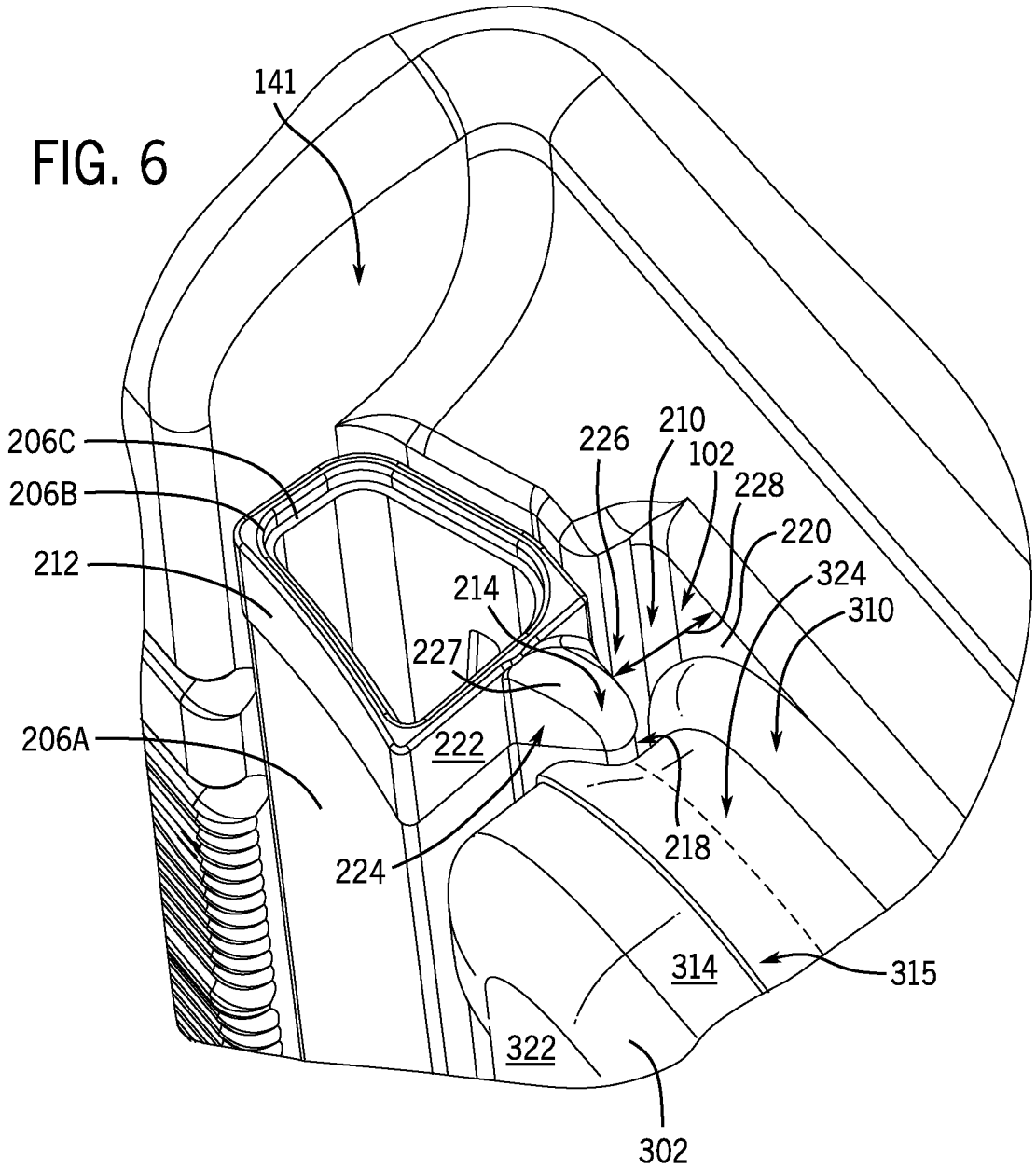
FIG. 6 is a simplified isometric view showing a guide member and a portion of a track feature of the removable storage system of FIG. 1.

The insertion of the pocket 302 into the recess 102 requires that the rail features 310 are aligned with the respective track features 210 in order to move the pocket 302 along the length of the recess 104 to the seated or fully engaged position. In one example, the initial insertion of the leading edge 317 of the opposing rail features 310 is enhanced by a lead-in structure at the top of each retaining edge 208. FIG. 6 shows an example of the lead-in structure, which in this example is a cap 212 that may be coupled to, or formed with, the tow handle tube 206*a*. The cap 212 may be disposed on an end of the tow handle tube. The cap 212 may be adapted to initiate, facilitate, or assist in the insertion of the rail feature 310 into the track 210. The cap 212 may include a shoulder 214 that protrudes transversely into the recess 102. The shoulder 214 may be positioned on the laterally inside face 222 of the cap 212 and adapted to facilitate the slidable engagement of the rail features 310 with the track 210. For example, the cap 212 may include a shoulder 214 that protrudes laterally from the cap 212 laterally toward a center line of the recess 102. The shoulder 214 may include a rear face 224, a front face 226, and a top portion 227 between the rear face 224 and the front face 226. The shoulder 214 may be tapered to form a transition from the open profile of the recess 102 to the profile of the retaining edge 208. Thus, the shoulder 214 may act as a funnel to capture the rail features 310 and begin to guide the rail feature 310 into the track 210. For example, the front face 226 of the shoulder 214 may be spaced in the depth direction 132 from the wall 104 a dimension 228 that is larger than a depth dimension 230 of the track features 210. The depth of the gap may smoothly transition from the dimension 228 to the dimension 230 of the track features 210. In some examples, the cap may be formed from plastic that may be injection molded, machined, blow molded or similarly formed and coupled to the tow handle tube 206A.

Figure 7:
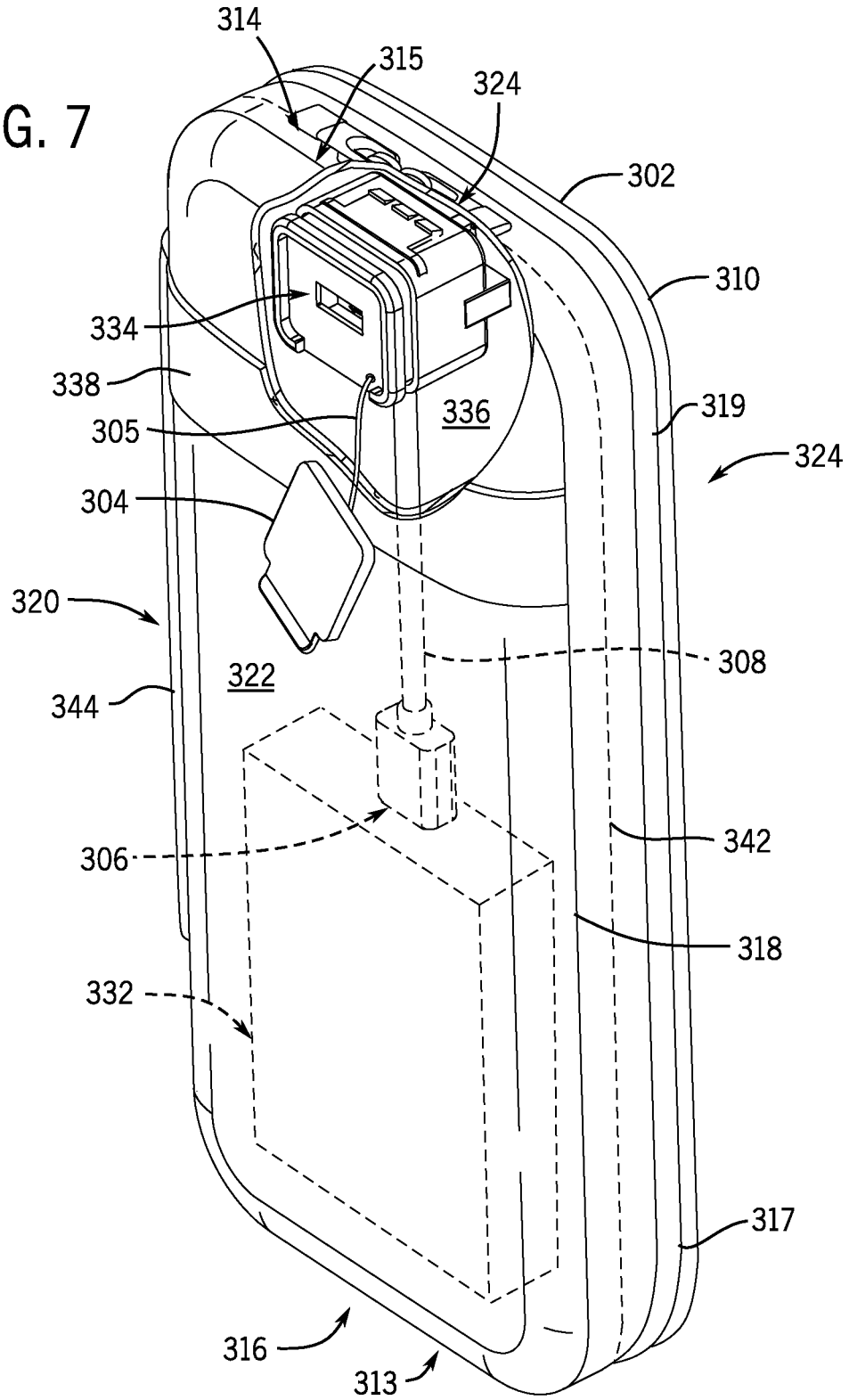
FIG. 7 is an isometric view of the removable pocket of the removable storage system of FIG. 1 with a portion of the rear panel cut away to show an optional power source 332.

FIG. 7 shows a partial cut away view of a pocket 302. In some examples, a pocket 302 is suitable to include a power source 332. The internal storage volume of the pocket may be suitable to contain a power source. A power source may be a battery or power pack suitable to supply power to an electronic device such as a mobile phone, laptop, tablet, game console, or the like. The power source 332 may be removable from the pocket 302 such as via a closure 342 in the pocket 302, as previously described. The power source 332 may include a power interface 306 suitable to supply electrical power from the power source 332. The power interface 306 may be suitable to receive electrical power into the power source 332, so as to recharge the power source 332. An external power interface 334 may be coupled to a rear panel 322 of the plurality of panels of the pocket 302. The external power interface 334 may be located on the upper portion 356 of the rear panel 322, the central portion 358 of the rear panel 322, or the lower portion 360 of the rear panel 322. In some examples, more than one external power interface may be located on the rear panel 322 in any of the upper portion 356, central portion 358, and/or lower portion 360. The power source 332 may include an internal power interface 306 and may be disposed within the internal storage volume 336 of the pocket 302. In some examples, portions of the external power interface 344 inside the pocket 302 may be concealed behind a cover 372.

A cable 308 may be in electrical communication with the internal power interface 306 and the external power interface 334 and operative to supply electrical power from the power source 332 to the external power interface 334. The power interface 306 may be may be in electrical communication with an external power interface 334 via a cable 308. The external power interface 334 may be coupled to, or formed with, the pocket 302. For example, the external power interface 334 may be coupled to the rear panel 322 of the pocket 302. In many examples, the power interfaces 306 and 334 are universal serial bus (USB) interfaces suitable to supply power to an electronic device. The power interfaces 306, 334 may be any generation or variant of a USB interface including USB A, USB B, USB C, micro-USB A, micro-USB B, mini USB B (5-pin), mini USB B (4-pin), USB 3.0 A, or the like. The power interfaces 306, 334 may be other suitable types of interfaces such as Apple Lightning™, FireWire (IEEE 1394), power over Ethernet, or the like.

A portion of the external power interface 334 may be selectively coverable by a lid 304. For example, the lid 304 may cover electrical contacts of the external power interface so as to prevent such contacts from becoming dirty, contaminated, or wet. The lid 304 may be secured to the pocket 302 by a tether 305. The tether may be coupled to the cover. The tether 305 may be coupled to the external power interface 334. The tether 305 may be coupled to the rear panel 322. The tether 305 may be operative to retain the lid 304 when the lid 304 is removed from the external power interface 334. The tether 305 may be any suitable structure that allows the lid 304 to be removed from the external power interface 334 far enough to access the external power interface 334, yet keep the cover close enough such that it does not get lost or damaged. For example, the tether 305 may be a string, elastomeric filament, cable, chain, rope, or the like. The lid 304 may be secured to the external power interface 334 such as by a clip or snap fit suitable to hold the lid 304 in place when the external power interface 334 is not in use. The external power interface 334 may have an advantage of enabling the charging of a personal electronic device without removing the pocket 302 from the luggage article 100.

Figure 8A:
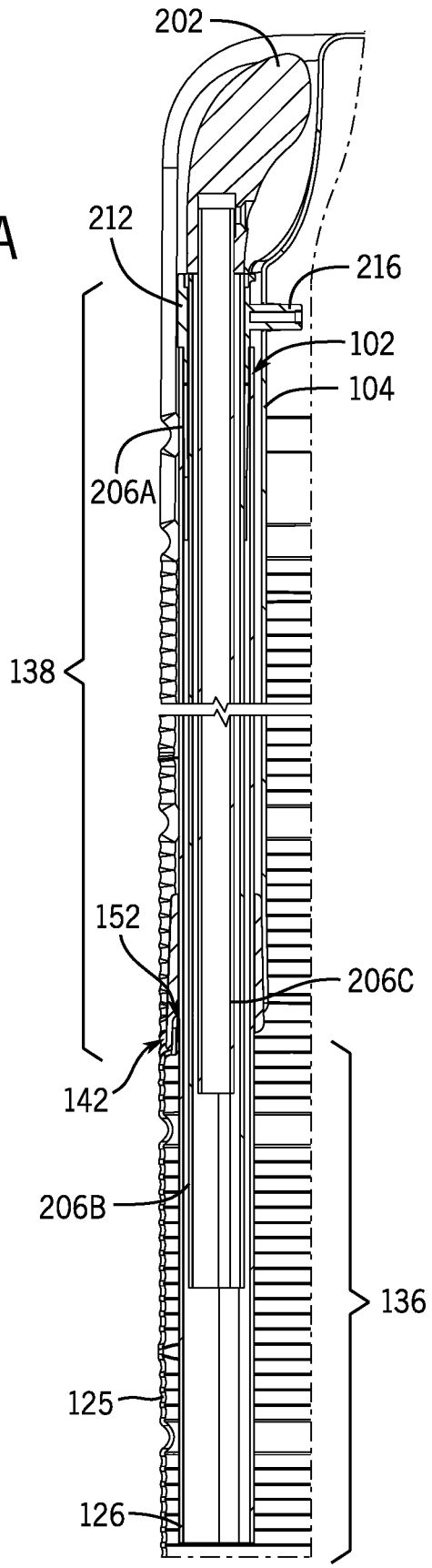
FIG. 8A is a section view of a tow handle tube taken along section line 8-8 of FIG. 1.
Figure 8B:
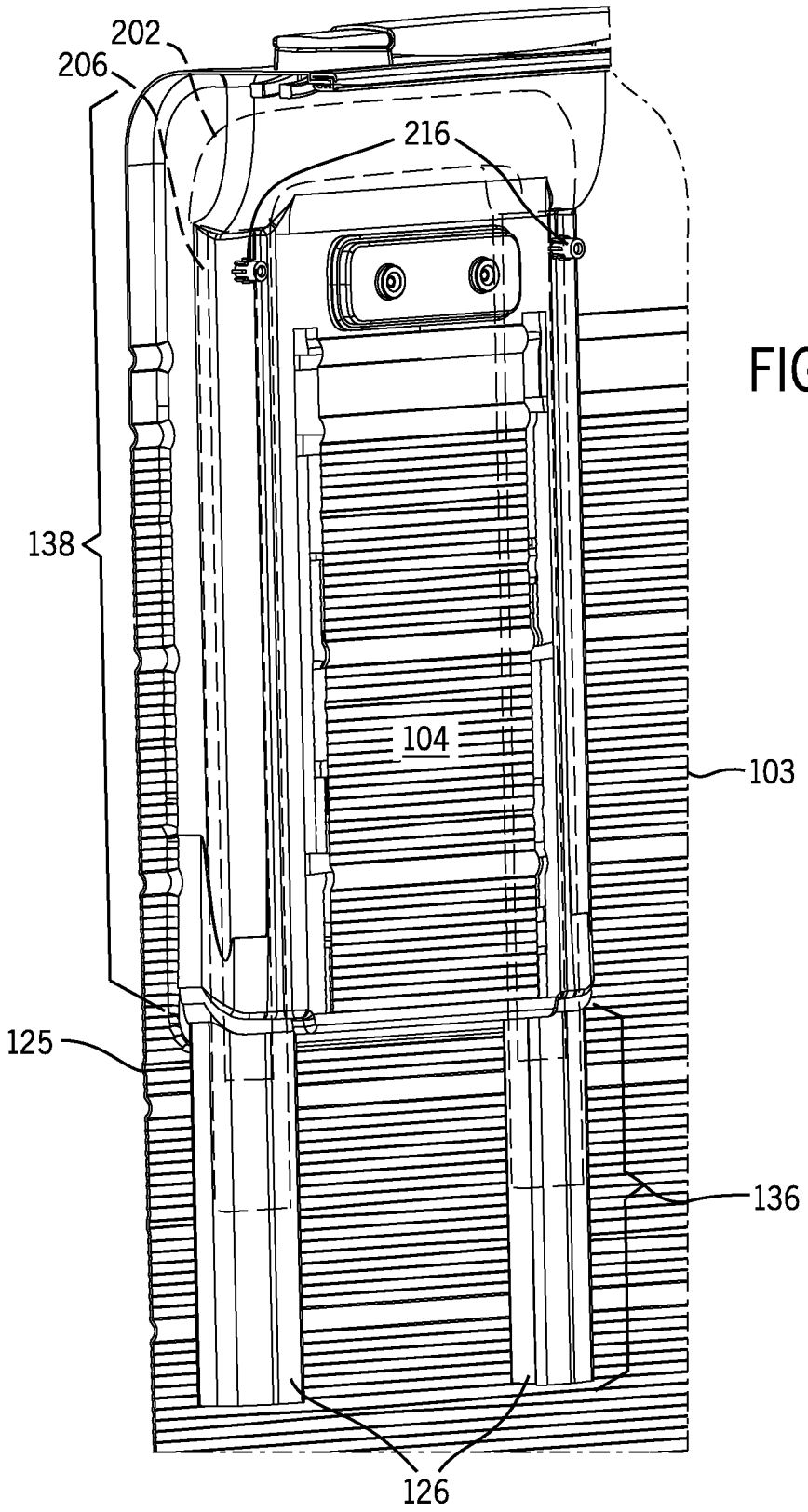
FIG. 8B is partial isometric view of the inside of the rear shell 103 of the luggage article 100 of FIG. 1.

FIG. 8A shows a partial section view of the tow handle tubes 206*a*-206*c* of the luggage article 100. FIG. 8B shows an isometric view of the inside of the rear shell 103. As shown in FIGS. 8A and 8B, the tow handle tube 206*a* may be secured to the rear panel 125 of the luggage article 100 by a fastener 216. The fastener 216 may be any suitable type of fastener, such as a screw, bolt, rivet, pin, or the like. The outer tow handle tube 206*a* may extend through an opening 152 in the lower wall 142 of the recess 102. The outer tow handle tube 206*a* may have an upper section 138 exposed to the outside of the luggage article 100 above the lower wall 142. The outer tow handle tube 206*a* may include a lower section 136 that is received in the inner storage compartment of the luggage article 100 below the lower wall 142. For example, the outer tow handle tube 206*a* may extend through an aperture 152 in the lower wall 142 of the rear panel 125 such as at a lower portion 148 of the recess 102. A housing 126 may be provided in the internal storage volume of the luggage article 100 to receive the tow handle tubes 206. The housing 126 may prevent the tow handle tubes 206 from contacting, snagging on or interfering with contents of the luggage article 100. The housing 126 may be coupled to the front panel 127 of the luggage article 100 by any suitable method such as a snap-fit interface, adhesive, fasteners, or the like.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage article comprising:

a rear panel;

a grip handle including a pair of spaced-apart telescopic tubes mounted on the rear panel;

a recess defined between the tubes; and a softside removable pocket removably mountable in the recess between the tubes, wherein the removable pocket and the recess include corresponding inter-engaging engagement features to retain the pocket at least partially within the recess, and wherein when the removable pocket is positioned in the recess, the pocket is flush with the rear panel of the luggage article.

2. The luggage article of claim 1, wherein:

the inter-engaging engagement feature of the pocket includes a rail feature;

the inter-engaging engagement feature of the recess includes a track feature; wherein the rail feature is adapted to be received in the track feature to retain the pocket at least partially within the recess.

3. The luggage article of claim 2, wherein the rail feature is adapted to be slidably received in the track feature to removably couple the pocket with the luggage article.

4. The luggage article of claim 3, wherein the pocket is removed by sliding the pocket out of an upper end of the recess.

5. The luggage article of claim 1, wherein the grip handle is selectively positionable between a retracted position and an extended position, wherein when the grip handle is in the retracted position, the grip handle is disposed above the pocket and retains the pocket within the recess.

6. The luggage article of claim 2, wherein the rail feature extends along at least a portion of a length of each opposing sidewall of the pocket.

7. The luggage article of claim 2, wherein the rail feature includes a wire loop extending around the entire periphery of the pocket.

8. The luggage article of claim 1, wherein the pocket comprises a main body with a plurality of panels defining an internal storage volume.

9. The luggage article of claim 1, wherein the softside removable pocket is made with a material comprising a fabric with a plastic backing.

10. The luggage article of claim 9, wherein the plastic backing includes ethylene vinyl acetate.

11. The luggage article of claim 8, further comprising:

an external power interface coupled to a panel of the plurality of panels.

12. The luggage article of claim 1, wherein the removable pocket is slidably received in the recess.

13. The luggage article of claim 1, wherein the pocket includes a closure mechanism that selectively exposes an opening to allow access to the internal storage volume of the pocket.

14. A luggage article comprising:

a rear panel;

a grip handle including a pair of spaced-apart tubes mounted on the rear panel;

a handle recess defined at least partially in the rear panel and configured to receive the grip handle;

a recess defined between the tubes; and a removable pocket removably mountable in the recess between the tubes, wherein the removable pocket and the recess include corresponding inter-engaging engagement features to retain the pocket at least partially within the recess, wherein when the grip handle is in a retracted position, the removable pocket is secured in the recess and when the grip handle is in an extended position, the removable pocket passes through the open handle recess as it is removed from the recess, and wherein when the removable pocket is positioned in the recess, the pocket is flush with the rear panel of the luggage article.

15. The luggage article of claim 14, wherein the handle recess comprises a rear wall and two sidewalls defined in the rear panel.

16. The luggage article of claim 14, wherein:

the inter-engaging engagement feature of the pocket includes a rail feature;

the inter-engaging engagement feature of the recess includes a track feature; wherein the rail feature is adapted to be received in the track feature to retain the pocket at least partially within the recess.

17. The luggage article of claim 16, wherein the rail feature includes a wire loop extending around the entire periphery of the pocket.

18. The luggage article of claim 14, wherein the removable pocket is made of a softside material.

19. The luggage article of claim 14, wherein an outward facing panel of the pocket is flush with an outer surface of the rear panel of the luggage article.

* * * * *